United States Patent [19]

Boudreau

[11] Patent Number: 4,575,113

[45] Date of Patent: Mar. 11, 1986

[54] WHEELCHAIR KIT FOR A FOLDING CHAIR

[76] Inventor: Dennis D. Boudreau, 3671 NE. 11th Ave., Fort Lauderdale, Fla. 33334

[21] Appl. No.: 616,818

[22] Filed: Jun. 4, 1984

[51] Int. Cl.[4] ..... B62B 7/10

[52] U.S. Cl. ..... 280/650; 280/79.2; 280/657; 297/DIG. 4

[58] Field of Search ..... 280/35, 642, 644, 647, 280/649, 650, 657, 658, 79.2, 242 WC; 297/DIG. 4

[56] References Cited

U.S. PATENT DOCUMENTS

| | | | |
|---|---|---|---|
| 466,573 | 1/1892 | Platto . | |
| 2,537,909 | 1/1951 | Puddester | 155/30 |
| 2,558,144 | 6/1951 | McComie | 280/35 |
| 2,578,488 | 12/1951 | Placerean . | |
| 2,648,073 | 8/1953 | Nowell | 280/35 |
| 2,961,250 | 11/1960 | Beach | 280/35 |
| 2,978,053 | 4/1961 | Schmidt | 180/26 |
| 3,542,419 | 11/1970 | Spinola | 297/130 |
| 3,887,228 | 6/1975 | Ingerson | 280/650 |
| 3,945,449 | 3/1976 | Ostrow | 180/6.5 |

*Primary Examiner*—John A. Pekar
*Assistant Examiner*—Joseph G. McCarthy
*Attorney, Agent, or Firm*—Oltman and Flynn

[57] ABSTRACT

A kit for attaching a set of wheels to a folding chair, thereby making it into a wheelchair combination for non-ambulatory persons. The kit consists of two side braces and two cross braces that are detachably connected at the ends by means of corner joints so that they form a frame with wheels attached to its underside. Hook bolts with wing nuts are used to connect the frame to the folding chair for quick attachment. The side braces can be folded back at one end to form foot rests.

6 Claims, 8 Drawing Figures

WHEELCHAIR KIT FOR A FOLDING CHAIR

BACKGROUND AND PRIOR ART

The invention relates to wheelchairs for persons that are not ambulatory, and more particularly to a kit for quick attachment to a folding chair for producing a folding wheelchair combination.

Inventors have in the past sought ways to make it more convenient to move a non-ambulatory person. Wheel chairs especially adapted for such persons have long been known and used. Wheelchairs, however, even of the collapsible folding type, are rather bulky when they have to be moved from one location to another, especially when they have to be moved in airplanes or in personal vehicles.

U.S. Pat. No. 3,945,449 shows an electric power attachment for a chair.

U.S. Pat. No. 3,542,419 shows a kit for assembling a child's highchair.

U.S. Pat. No. 2,978,053 shows an electric power attachment for a conventional wheelchair.

U.S. Pat. No. 2,537,909 shows an invalid chair having both wheels and friction levers for placing the chair in a fixed position.

U.S. Pat. No. 2,578,488 shows a roller attachment for a chair.

U.S. Pat. No. 466,573 shows a roller attachment for a rocking chair.

SUMMARY OF THE INVENTION

The present invention discloses an attachment in the form of a kit for a chair and especially for a folding-type lawn chair that provides a frame with casters that can quickly and easily be attached to almost any conventional folding lawn chair, so that the resultant combination forms a wheelchair for a non-ambulatory person.

One of the novel advantages of the invention resides in the ease with which it can be attached to a folding lawn chair.

Another advantage resides in the compactness of its parts, so that the kit can readily be transported from one location to another even in personal vehicles and on commercial flights.

The invention consists essentially of a light frame that can be attached to the underside of a folding lawn chair by means of hook bolts or the like and wing nuts, and has caster wheels attached thereto, providing in combination with the folding lawn chair a wheelchair for a non-ambulatory person which can be folded into a small, flat package for easy transportation or storage, yet is sturdy enough for holding a grown person who needs a wheelchair. Since folding lawn chairs are readily available at a relatively low cost almost everywhere, such a combination has unique utility for non-ambulatory individuals who have to travel and who cannot readily bring with them a conventional wheelchair.

Further objects and advantages of this invention will be apparent from the following detailed description of presently preferred embodiments which are illustrated schematically in the accompanying drawings.

DETAILED DESCRIPTION OF THE PREFERRED EMBODIMENTS

Figure 1:
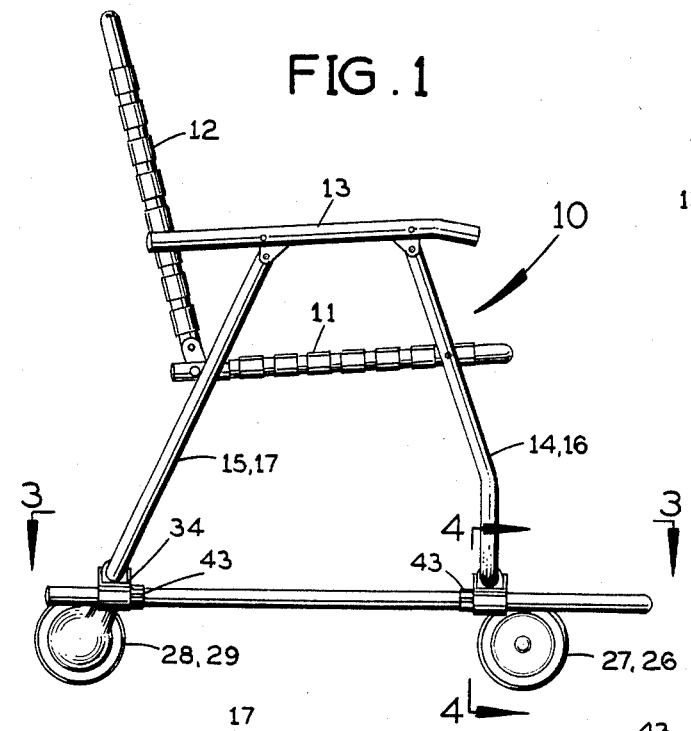
FIG. 1 is an elevational side view of a folding lawn chair with the wheelchair kit attached thereto.
Figure 2:
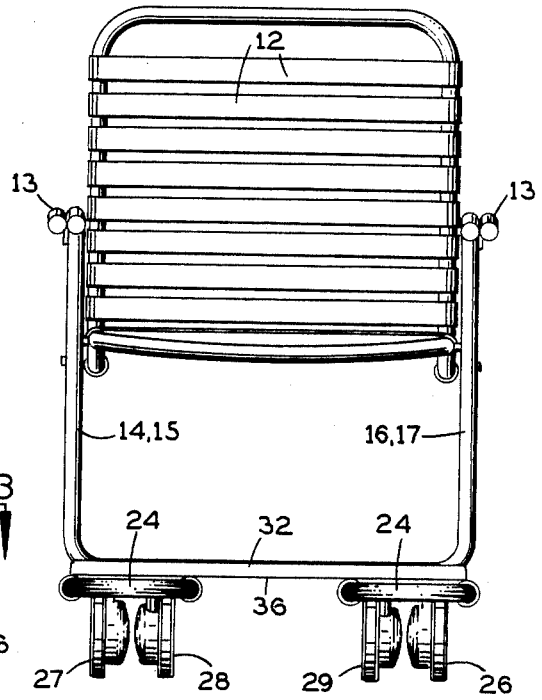
FIG. 2 is an elevational front view of a folding lawn chair with the wheelchair kit attached thereto.
Figure 3:
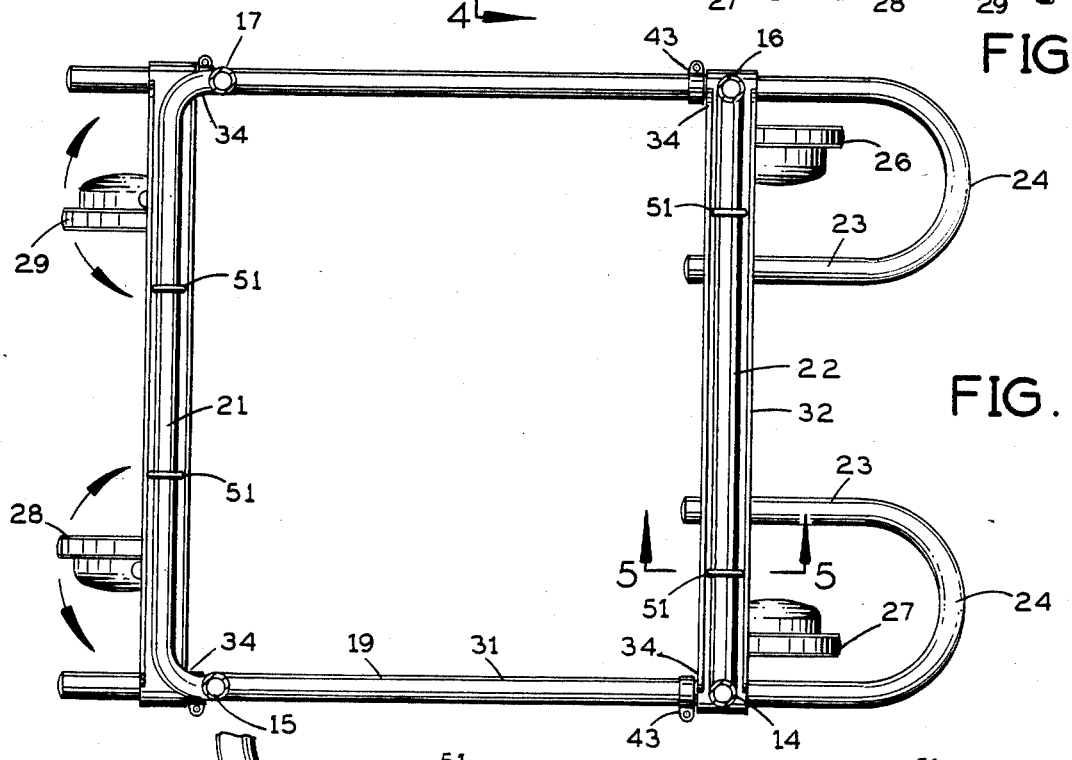
FIG. 3 is a top-down plan view of the invention, seen along the line 3—3 of FIG. 1.
Figure 4:
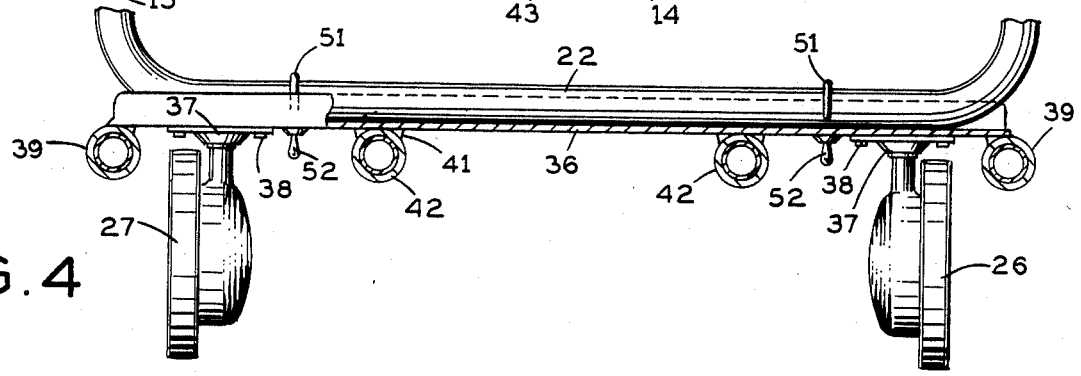
FIG. 4 is an elevational, fragmentary front view of the wheel chair kit seen along the line 4—4 of FIG. 1.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

In the following description the invention is described in the physical orientation shown in the drawings.

In FIG. 1 a conventional folding lawn chair, generally at 10, is shown; the lawn chair is of a construction commonly used and consists of a seat 11, a backrest 12, armrests 13, left and right front legs 16 and 14, respectively, and left and right rear legs 17 and 15, respectively. The two front legs are joined at their bottom ends by a horizontal front cross part 22, and the rear legs are joined similarly by a rear cross part 21. The seat 11 and the backrest 12 are shown covered with a web consisting of suitable plastic strips for supporting a person sitting in the chair. In its folded collapsed condition, the wheelchair fits in a low-profile configuration shown in FIG. 7. Other types of folding lawn chairs are shown, but most types are similar to the hereinabove described chair construction.

The wheelchair kit, according to the instant invention, as seen in the figures, consists of left and right side braces 18 and 19, respectively, and front and rear cross braces 32 and 33, respectively. Each side brace 18 and 19 consists of a long, straight, shank part 31 and a U-shaped curved front part 24 that is bent back into a short, straight part 23, so that each side brace resembles a walking cane with a curved handle 24.

Figure 5:
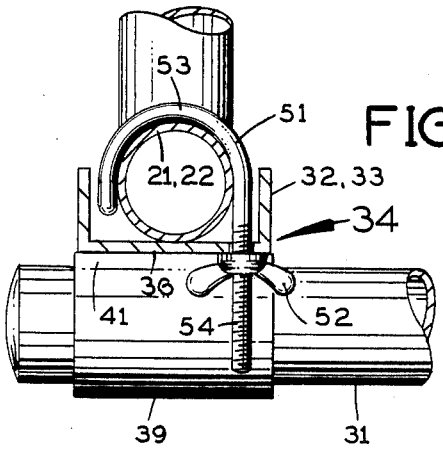
FIG. 5 is an enlarged, fragmentary detailed view of a corner joint for securing the corners of the frame along the line 5—5 of FIG. 3.

The front and rear cross braces 32 and 33, respectively, each consists of a section of channel each with a cross-section as a squared, upward-facing letter U, best seen in FIG. 5. The side braces 18 and 19 and the front and rear braces 32 and 33, respectively, are joined at corner joints 34 to form a rigid, rectangular frame, which supports on its underside, front wheels. These two front wheels 26 and 27 are mounted rigidly, non-swiveling to the underside 36 of the two cross braces by means of mounting plates 37 that are secured by means of screws, rivets or the like 38 to the channel 36. The two rear wheels 29 and 28, left and right, respectively, are caster wheels that are attached swivelly about a vertical axis to the two rear-mounting plates 39. These rear wheels are also attached by means of screws, rivets or the like 38 to the underside 36 of the rear cross brace channel 33.

The rear wheels may advantageously be spaced apart a little less than the front wheels in order to provide greater ease of maneuvering the wheelchair.

Figure 6:
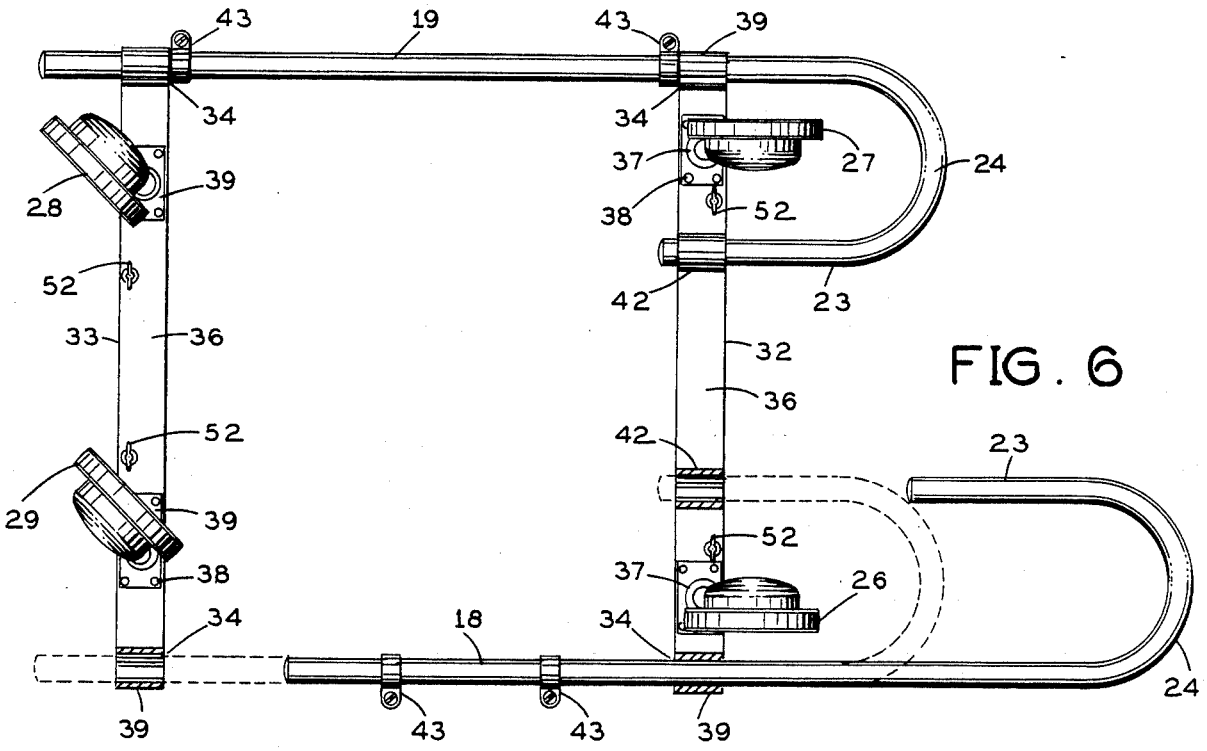
FIG. 6 is a upward-looking, plan view of the underside of the invention showing the foot rests, the wheels and other details.

The corner joints 34, one of which is seen in FIG. 5, in accordance with the teachings of the invention, each consists of a short, tubular collar 39 that is attached transversely to the underside 36 of the channels 32,33 near the ends thereof by means of a welding or brazing seam 41 or the like, so that a strong, rigid connection is provided. Two additional inside collars 42 are mounted closer together on the front cross brace 32. The collars 39 and 42 have an inside diameter slightly greater than the outside diameter of the tubular material used for construction of the side braces 18 and 19 and serve to receive in a snugly fitting and slidable connection the two side braces 18 and 19, such that the two long shank parts 31 are received in the outside collars 39, and the short shank parts 23 are received in the two inside collars 42, as best seen in FIG. 6. The left brace 18 is seen partially inserted in full lines and in its operative fully inserted position in broken lines.

The right side brace 19 is seen fully inserted.

Figure 8:
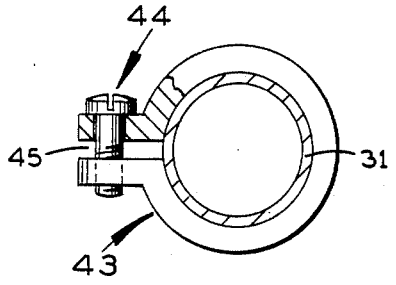
FIG. 8 is an elevational view of a stop ring.

Two stop rings 43 are provided on each side brace 18 and 19. The stop ring 43 is shown enlarged in FIG. 8; it has a radial slot 45 that can be tightened by a tangentially oriented screw 44, so that the stop ring, when positioned on the side braces 18 and 19 as shown in FIG. 6, prevents the brace from sliding in either direction when the screw 44 is drawn tight.

The folding lawn chair 10 is attached to the channels 32 and 33 by means of hook bolts 51, best seen in FIG. 5. The hook bolt 51 has an upper open circular hook 53 that fits around the front and rear cross parts 21,22 between the legs of the folding lawn chair 10. The hook bolt 51 has a threaded shank 54 downward projecting through the channels 32,33 with a wing nut 52 for tightening the hooks 51 against the cross parts 21,22, thereby securing them to the bottom of the upwardly-facing channels 32,33. It follows that the hook bolt 51 may be configured in other ways, such as a U-bolt with two threaded shanks each with a wing nut, or in other suitable ways that allow quick disassembly of the folding chair 10 from the wheelchair kit.

In operation, the wheelchair kit shown assembled with a folding lawn chair 10 in FIG. 1, serves to accommodate a person who can sit in the chair with his/her feet resting on the two curved sections 24, while the chair can be pushed by another person positioned behind the chair.

Figure 7:
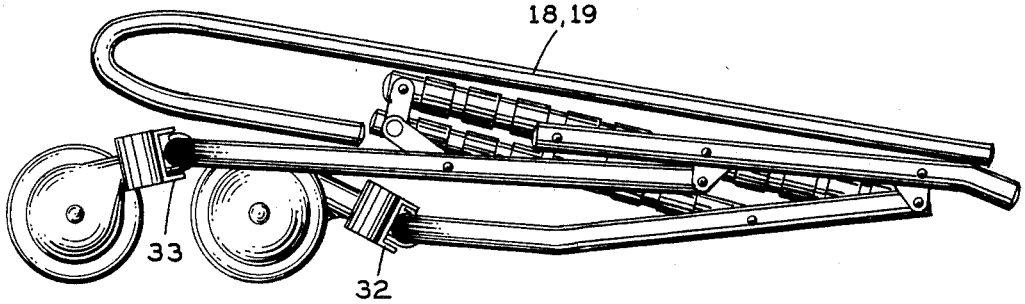
FIG. 7 is a side view of a folding lawn chair with the wheelchair kit attached, showing the complete assembly in folded condition.

When needed, the lawn chair can be folded into a lowprofile assembly as shown in FIG. 7 for storage or transport. In preparation for the folding. The stop rings 43 are loosened, and the two side braces 18 and 19 are pulled out as shown in FIG. 6. After removal of the cross braces, the folding law chair can be folded as shown in FIG. 7, to a low profile assembly that can readily be stored or transported.

In another mode of usage, the two cross braces 32,33 may also be detached, and together with the side braces 18 and 19, shipped to another location for use with another lawn chair, and without the need for shipping the chair itself.

I claim:

1. A wheel chair kit for a folding chair, the kit comprising:

two side braces;

a front and a rear cross brace;

corner joints for detachably attaching the cross braces to the side braces at their ends for forming a rectangular frame having four corners;

four wheels attached to the underside of the cross braces proximal to the corners;

means for detachably attaching the folding chair to the top side of the frame, thereby forming a wheelchair assembly;

said corner joints comprising four outside collars rigidly, transversely attached to the underside of said cross braces for slidably receiving said side braces;

said side braces being curved back at one end to form a curved section and a short straight shank section, said curved section forming a foot rest for a person sitting in the chair;

two inside collars rigidly, transversely attached to the underside of said front cross brace, spaced apart a shorter distance than said two outside collars on the front cross brace, for receiving the short shanks of the side braces.

2. A wheelchair kit according to claim 1 wherein the two rear wheels are caster wheels for making the wheelchair kit steerable.

3. A wheelchair kit according to claim 1 wherein said means for attaching said folding chair to said frame comprises a plurality of hook bolts, each hook bolt having a threaded shank and a wing nut for detachably attaching said folding chair to said cross braces.

4. A wheelchair kit according to claim 1 wherein said side braces are made of tubular stock.

5. A wheelchair kit according to claim 4 wherein said cross braces are made of channel stock.

6. A wheel chair kit for a folding chair, the kit comprising:

two side braces;

a front and a rear cross brace;

corner joints for detachably attaching the cross braces to the side braces at their ends for forming a rectangular frame having four corners;

four wheels attached to the underside of the cross braces proximal to the corners;

means for detachably attaching the folding chair to the top side of the frame, thereby forming a wheelchair assembly, stop rings having a screw across a radial slot in the stop ring for securing the stop rings to the side braces and for preventing axial movement of said side brace in relation to said cross braces.

* * * * *